US008267430B2

(12) United States Patent
Fischer

(10) Patent No.: US 8,267,430 B2
(45) Date of Patent: Sep. 18, 2012

(54) COPLANAR-JOINED PRINTING CARRIER MADE FROM AT LEAST TWO PARTIAL PRINTING CARRIERS, THE PARTIAL PRINTING CARRIERS, AND THE METHOD FOR THEIR FABRICATION

(75) Inventor: Jules Fischer, Oberwil-Lieli (CH)

(73) Assignee: Fofitec AG, Dottikon (CH)

( * ) Notice: Subject to any disclaimer, the term of this patent is extended or adjusted under 35 U.S.C. 154(b) by 586 days.

(21) Appl. No.: 12/313,360

(22) Filed: Nov. 19, 2008

(65) Prior Publication Data

US 2009/0277351 A1 Nov. 12, 2009

Related U.S. Application Data

(63) Continuation-in-part of application No. 12/288,528, filed on Oct. 21, 2008.

(30) Foreign Application Priority Data

May 9, 2008 (CH) ..... 0785/08
Jun. 3, 2008 (CH) ..... 0839/08

(51) Int. Cl.
*B42D 15/00* (2006.01)

(52) U.S. Cl. ..... 283/17; 428/40.1; 428/156; 40/661.09; 40/654.01; 40/586

(58) Field of Classification Search ..... 281/17; 283/61, 81; 428/40.1, 57–61, 81, 83, 84, 428/192; 40/661.09
See application file for complete search history.

(56) References Cited

U.S. PATENT DOCUMENTS

| | | | | |
|---|---|---|---|---|
| 5,131,686 | A * | 7/1992 | Carlson | 283/75 |
| 6,159,570 | A * | 12/2000 | Ulrich et al. | 428/40.1 |
| 6,352,287 | B2 * | 3/2002 | Casagrande | 283/81 |
| 6,517,921 | B2 * | 2/2003 | Ulrich et al. | 428/40.1 |
| 6,749,230 | B1 * | 6/2004 | Casagrande | 283/61 |
| 6,991,259 | B2 * | 1/2006 | Schwarzbauer et al. | 283/62 |
| 7,288,163 | B2 * | 10/2007 | Weirather et al. | 156/248 |
| 7,627,972 | B2 * | 12/2009 | Hodsdon et al. | 40/661.09 |

FOREIGN PATENT DOCUMENTS

| | | |
|---|---|---|
| DE | 197 41 563 | 3/1998 |
| WO | WO 92/05036 | 4/1992 |
| WO | WO 95/20493 | 8/1995 |
| WO | WO 00/41895 | 7/2000 |
| WO | WO 2005/100006 | 10/2005 |

* cited by examiner

*Primary Examiner* — Lesley D Morris
*Assistant Examiner* — Shin Kim
(74) *Attorney, Agent, or Firm* — D. Peter Hochberg; Sean F. Mellino; Daniel J. Smola

(57) ABSTRACT

A coplanarly joined print carrier composed of at least two laminar partial print carriers. One of the partial print carriers contains a paper layer. The paper layer of one partial print carrier is attenuated in thickness along an edge strip by removing a partial layer. The other partial print carrier has a lesser thickness along one edge strip than elsewhere. The two partial print carriers are bonded together along their two edge strips. A method suitable for making such a print carrier is also provided.

38 Claims, 13 Drawing Sheets

Fig.1a)
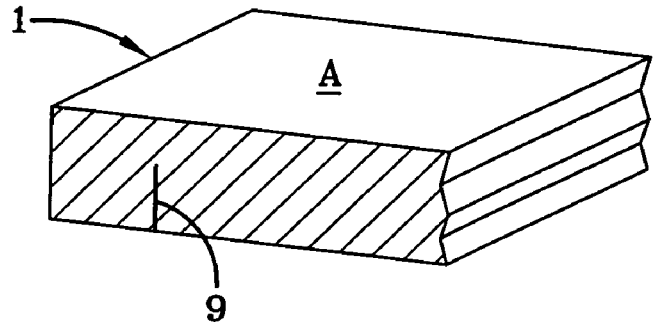
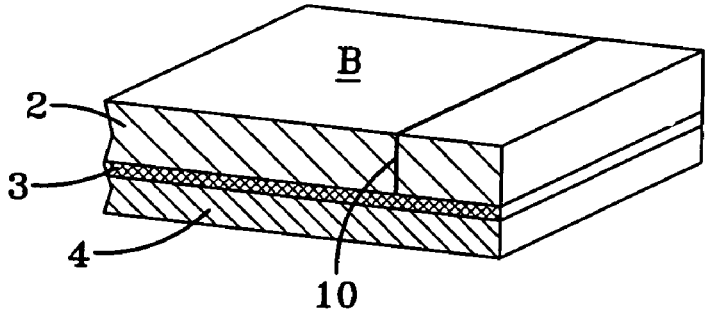
Fig.1b)
Fig.1c)
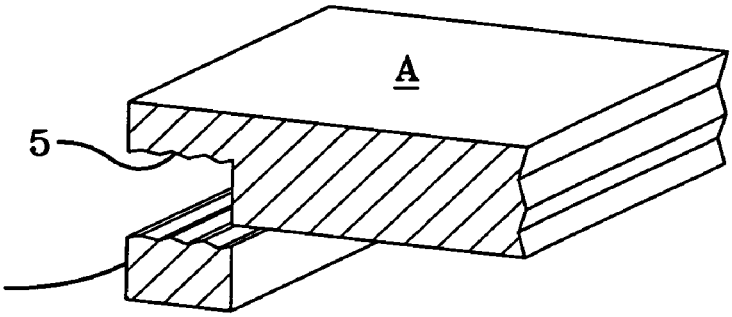
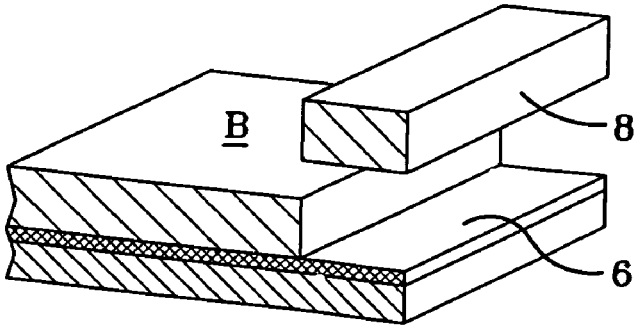
Fig.1d)

A/B
A
B
12
14
11
10
6
5
9
45
44
43
42
46
41
40
39
38
37
36
35
34
33
32
31
30
28
27
26
25
24
23
22
21
20
8
7
S1
S2
S3
K1
I
II
III
IV
V

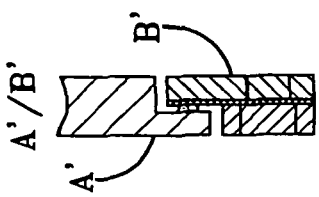
Fig.2c')
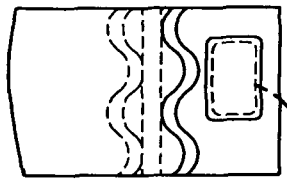
Fig.2b')
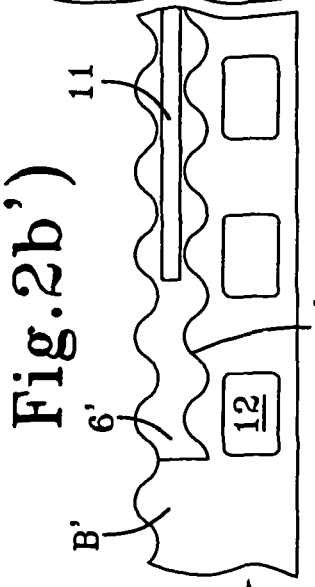
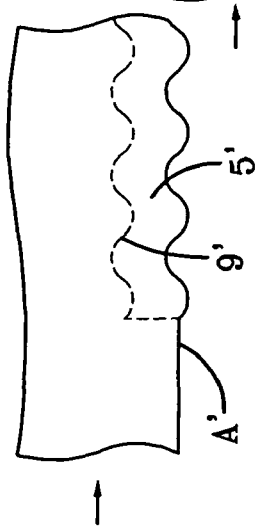
Fig.2d)
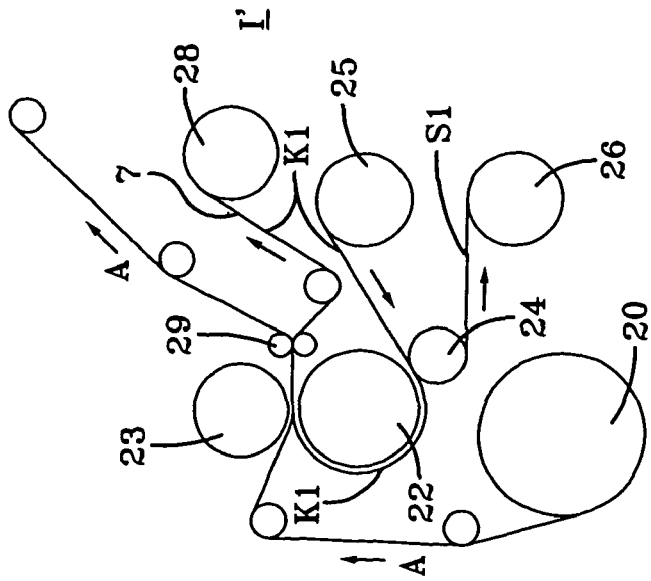

COPLANAR-JOINED PRINTING CARRIER MADE FROM AT LEAST TWO PARTIAL PRINTING CARRIERS, THE PARTIAL PRINTING CARRIERS, AND THE METHOD FOR THEIR FABRICATION

CROSS-REFERENCE TO RELATED APPLICATIONS

This application is a continuation-in-part application of co-pending U.S. application Ser. No. 12/288,528, filed Oct. 21, 2008, which claims foreign priority based on Swiss Patent Application No. 00785/08, filed on May 9, 2008 and Swiss Patent Application No. 00839/08, filed on Jun. 3, 2008, the content of which are incorporated herein by reference in their entireties.

BACKGROUND OF THE INVENTION

1. Technical Field

The present invention concerns a coplanarly joined print carrier made from at least two laminar partial print carriers, wherein one of the partial print carriers has a paper layer. The invention also concerns a partial print carrier with a paper layer, as well as a method for making such a print carrier and partial print carrier.

A print carrier or partial print carrier within the context of the present invention is understood to be a substrate, especially a sheet, web, or page-like substrate, which is printed and/or can be printed on one or both sides. The substrate can have a single or multiple-layer construction.

2. Description of the Prior Art

Print carriers based on paper sheets are increasingly needed, which are improved by means of local affixed items, usually in conjunction with die-cutting, and which contain integrated cards or labels, for example. The affixed items generally involve laminates, which contain the plasticizing and adhesive layers required for the integrated cards or labels. As an example, reference may be made to WO 95/20493.

The affixed items cause local thickening of the printed carriers, which is not of any consequence for individual print-carrier sheets, but when placed in a stack, as it increases in height, it adds up and result in increasingly skewed stacking.

In order to avoid this skewed stacking, which prevents full loading of the magazines, various solutions have already been proposed.

One proposal according to DE 197 41 563 consisted of making a single print carrier with an integrated card, instead of local affixing, i.e., providing it with the layers needed for the integrated card over the entire surface. However, this solution could not be successful, due to the much larger quantity of costly material needed for this. Also, the print carriers in this embodiment are altogether quite rigid and heavy and can hardly be folded at all, due to the layers of film usually present.

A proposal according to WO 2005/100006 consisted of retaining partial affixing on part of the surface and preventing skewing of the sheets in the stack by means of increasing thickness deformations imprinted in the paper material. However, due to the high elasticity of paper, these deformations have shown themselves to be insufficiently stable over time.

A print carrier was proposed in WO 92/05036 in the form of a card laminate with a first card, made of paper, for example, and a second card, in which the second card is fastened at one segment of the first card incised under pressure and exhibits a surface which is coplanar with it, so that skewing cannot occur in the stack. However, it results from this that this proposal could not be successfully achieved because the impression in the paper material of the first card would break down over time, due to the high elasticity of paper, as was the case with the aforementioned deformations.

In WO 00/41895, a coplanarly joined print carrier made from at least two laminar partial print carriers, of the type mentioned at the beginning, was proposed, in which the partial print carriers are glued together at their contiguous edges with essentially no overlap. However, it was not possible to achieve a sufficient binding strength in practice, at least not at a reasonable cost.

SUMMARY OF THE PRESENT INVENTION

The invention poses the problem of specifying a print carrier of the kind mentioned at the outset, in which both partial print carriers are robustly joined together coplanarly in a technically simple and systematically executed way and in which the partial print carrier comprised of the paper layer can simply consist of this paper layer and the other partial print carrier can consist, in particular, of a laminate suitable for integrated cards.

This problem is solved according to the invention by means of a print carrier in accordance with the present invention. The print carrier according to the invention is characterized by the fact that the thickness of the paper layer of one partial print carrier is therefore attenuated along one edge strip by removing a partial layer, that the other partial print carrier exhibits a lesser thickness along one edge strip than elsewhere, and that both partial print carriers are joined together along their two edge strips.

The two partial print carriers can be firmly joined together with their two edge strips, in particular by mutual overlap. In the area of overlap, a total thickness can be obtained in this way which is no greater than the thickness of the partial print carriers elsewhere. Alternatively, the two partial print carriers could also be joined together by their edge strips by bonding with at least one strip, in particular an adhesive strip, in which the thickness of the strip will be offset by the lesser thickness of the partial print carriers in the area of their edge strips, and likewise by means of at least one strip will in sum cause no increase in thickness besides, compared to the thickness of the individual partial print carriers.

According to a first preferred embodiment of the invention, the partial layer is removed from the paper layer by tearing it off. In this regard, the invention utilizes the knowledge that paper material can be split and that a strip with a partial layer of the paper material can, after making a suitable rip, be further torn off almost continuously at an extremely constant thickness.

Alternatively or in addition, the partial layer could be removed by an abrasion process, in particular by grinding or milling.

If the second print carrier is a multilayered card laminate with at least two layers that can be separated from each other, a strip can be removed from at least one layer of this laminate and thereby likewise obtaining a thickness reduction along an edge strip.

Preferably, the edge strip of the paper layer of one partial print carrier is delimited from the rest of the paper layer by a cut in the paper layer.

The same holds true for the other partial print carrier, in particular if this is a laminate with at least two layers which can be peeled away from each other.

In a further preferred embodiment, the other partial print carrier is shorter in the direction of the edge strip than the partial print carrier containing the paper layer. This construction is then especially advantageous if the surfaces needed for an integrated card, for example, are less wide in the other partial print carrier. In particular, it has to be only half as wide as the print carrier containing the paper layer and the other partial print carrier is moreover of an expensive laminate.

One object of the invention is a partial print carrier with a paper layer for making a print carrier according to the invention, in which the thickness of the paper layer is attenuated along an edge strip by removing a partial layer. Preferably, the partial layer of the paper layer is removed by tearing it off. Alternatively or in addition, the partial layer could be removed by an abrasion process, in particular by grinding or milling.

The partial print carrier can be provided with an adhesive layer covered by a peel-off covering layer at the edge strip of the paper layer.

Moreover, an object of the invention is a method for making a print carrier or a partial print carrier according to the invention, in which the partial layer is removed from the paper layer by tearing it off along the edge strip.

Preferably, the partial layer of the paper layer is torn off with an adhesive strip. Critical to the resultant thickness here of the partial layer are the tear conditions. Preferably, the adhesive strip is pulled off, along with the partial layer of the adhering paper layer, using a roller. In continuous production, with the paper web and the adhesive strip in the form of continuous webs, the two webs are passed across two rollers that wind against one another. Due to the tear conditions which are very uniform here, corresponding, rather, to a lifting off, a very uniform thickness can be attained for the partial layer and, thus, also for the remaining layer of the paper layer along the edge strip. Above all, the thickness of the partial layer can be influenced here by the choice of diameter for the roller(s).

Another object of the invention is a method for making a print carrier or a partial print carrier according to the invention, in which the partial layer of the paper layer is removed along the edge strip by abrasion, in particular by grinding and/or milling.

As a result, the edge strip of the paper layer exhibits a smooth edge facing the rest of the paper layer; it is delimited by a cut in the paper layer, before removing the partial layer. The depth of the cut should correspond here to roughly the desired thickness of the partial layer.

Provided that the second print carrier is a multilayered laminate, the edge strip on it can likewise be delimited from the rest of the laminate before peeling off at least one layer by means of a cut in the laminate. The depth of the cut should correspond to at least the desired thickness of the partial layer.

A glued join is preferred for connecting the two partial print carriers along their two edge strips, with the two edge strips overlapping, in which, also preferably, if necessary, an adhesive layer is transferred dry from one carrier to one of the two edge strips. This has an advantage over a wet application of the adhesive layer, in that the adhesive layer is immediately available for gluing both partial print carriers and does not have to be dried first. A hot glue could also be considered, or a connection using an already existing coating by pressing the two webs together.

Finally, the method of the invention is preferably a continuous method, in which the two partial print carriers are present as webs and are processed, preferably at the same time, for example, by running off a roller. In addition to their being joined together, the two partial print carriers could also undergo further processing steps in the same run, such as, for example, printing or die-cutting, and finally separation.

In a further method according to the invention, two outer and one middle partial print carriers are used for the essentially waste-free manufacture of a print carrier, with the other partial print carrier shorter in the direction of the edge strip than the partial print carrier containing the paper layer, in which both outer partial print carriers each contain a paper layer and each is attenuated in thickness along an edge strip by removing a partial layer and in which the middle partial print carrier exhibits a lesser thickness along two facing edge strips than the thickness elsewhere. The outer partial print carriers are each bonded along their edge strips to one of the edge strips of the middle partial print carrier. Then the partial print carriers so connected are passed by means of an edge strip alternately facing one another and in between the middle partial print carrier crossing a parting line separates into at least two of the print carriers.

BRIEF EXPLANATION OF THE FIGURES

The invention will now be explained in more detail by means of embodiment examples with reference to the drawings. Shown schematically are:

FIG. 2*d*) shows a modified die-cut unit of the device illustrated in *a*);

In the figures, the size proportions of the various parts are not to scale. In particular, the thicknesses of the individual layers are represented greatly exaggerated for better recognition.

DETAILED DESCRIPTION OF THE PRESENT INVENTION

Figure 1E:
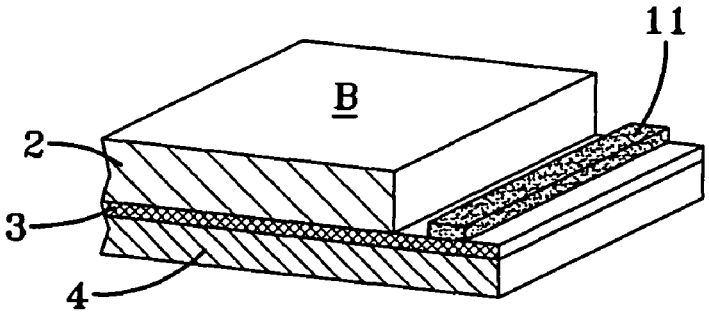
FIG. 1*g*) is a coplanarly joined print carrier according to the invention, composed of two partial print carriers, and FIGS. 1*a*)-*f*) are the individual steps for making this print carrier.
Figure 1F:
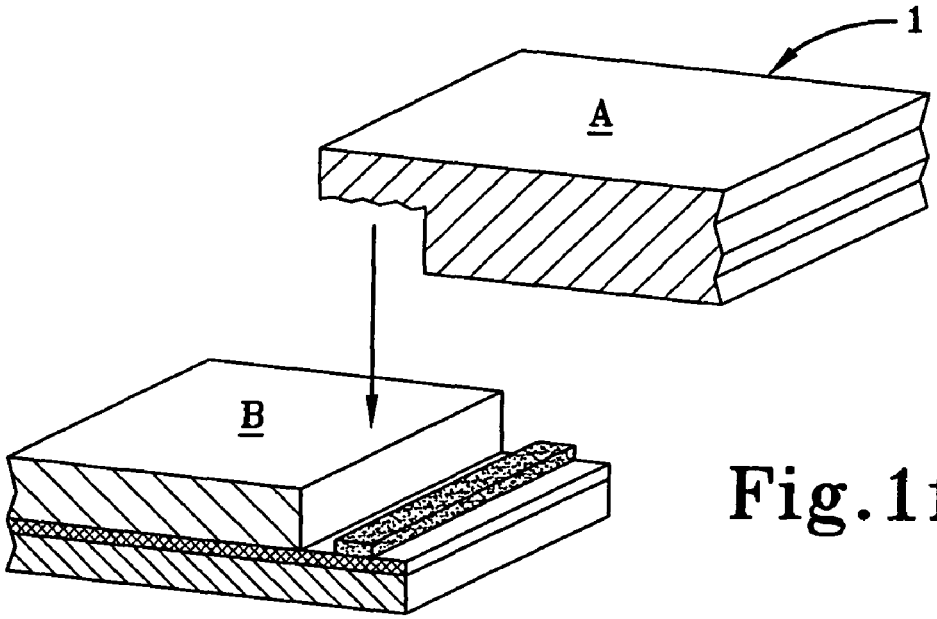
Figure 1G:
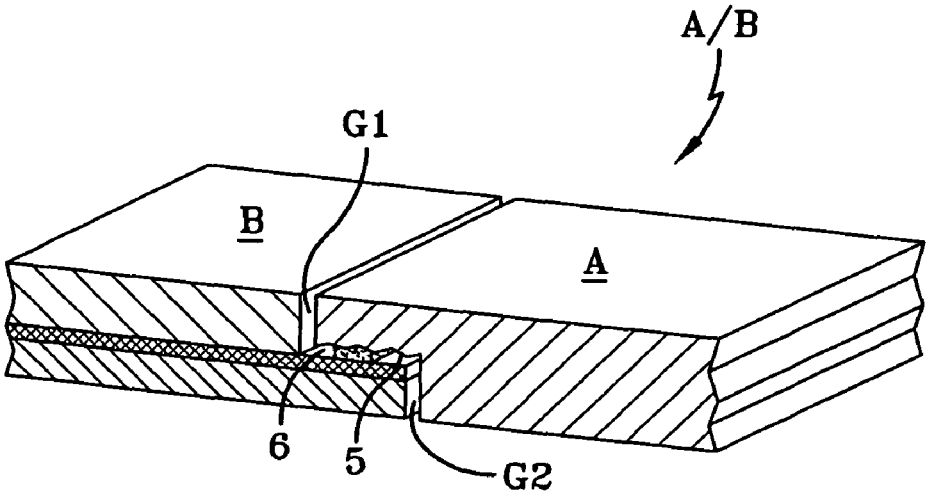

FIG. 1*g*) shows a print carrier A/B of two laminar partial print carriers A and B, joined coplanarly with mutual overlapping. The partial print carrier A consists of a single ply or layer 1 of paper. The partial print carrier B is a laminate with roughly corresponding thickness, made up of three layers 2, 3, and 4, in which layers 2 and 4 can likewise be a paper layer or a film layer and layer 3 is a so-called peelable adhesive layer, which allows the layer 2 to be separated from layer 3 and layer 3 thereby remains behind on layer 4.

For the purpose of their coplanar joining, the partial print carriers A and B are each attenuated in thickness along an edge strip 5 or 6 by removing a strip-like partial layer 7 from the partial print carrier A and a strip-like layer 8 from partial print carrier B. To facilitate this and to obtain a neat boundary for the edge strips 5 and 6, the partial print carriers A and B can be provided with cuts 9 and 10 beforehand. FIGS. 1*a*) and 1*b*) show the two partial print carriers A and B in their original state, but already provided with such cuts 9 and 10. FIG. 1*c*) shows the strip-like partial layer 7 of paper layer 1 along the cut 9 of paper layer 1 and is thus represented as separated from partial print carrier A, whereby the separation is achieved by tearing it off, with fraying of the paper material. FIG. 1*d*) shows the strip-like layer 8 along the cut 10 separated from partial print carrier B, whereby part of layer 2 is formed and is separated from the peelable adhesive layer 3. Then, on at least one of the attenuated edge strips 5 and/or 6, here edge strip 6 of partial print carrier B, an adhesive 11 is applied as a strip, as FIG. 1*e*) shows. As represented in FIG. 1*f*), the two partial print carriers A and B are finally glued together at their edge strips 5 and 6, mutually overlapping so that they come to lie essentially coplanar, as FIG. 1*g*) shows. With suitable attenuation of the two partial print carriers A and B, possibly allowing for the thickness of the glue 11, the same thickness is obtained, at most, in their area of overlap 5/6 as the two partial print carriers each have, as this is preferred. The print carrier A/B, which is assembled from the two partial print carriers A and B, then likewise exhibits an essentially consonant thickness over its entire surface.

Figures 2A, 2B, 2C:
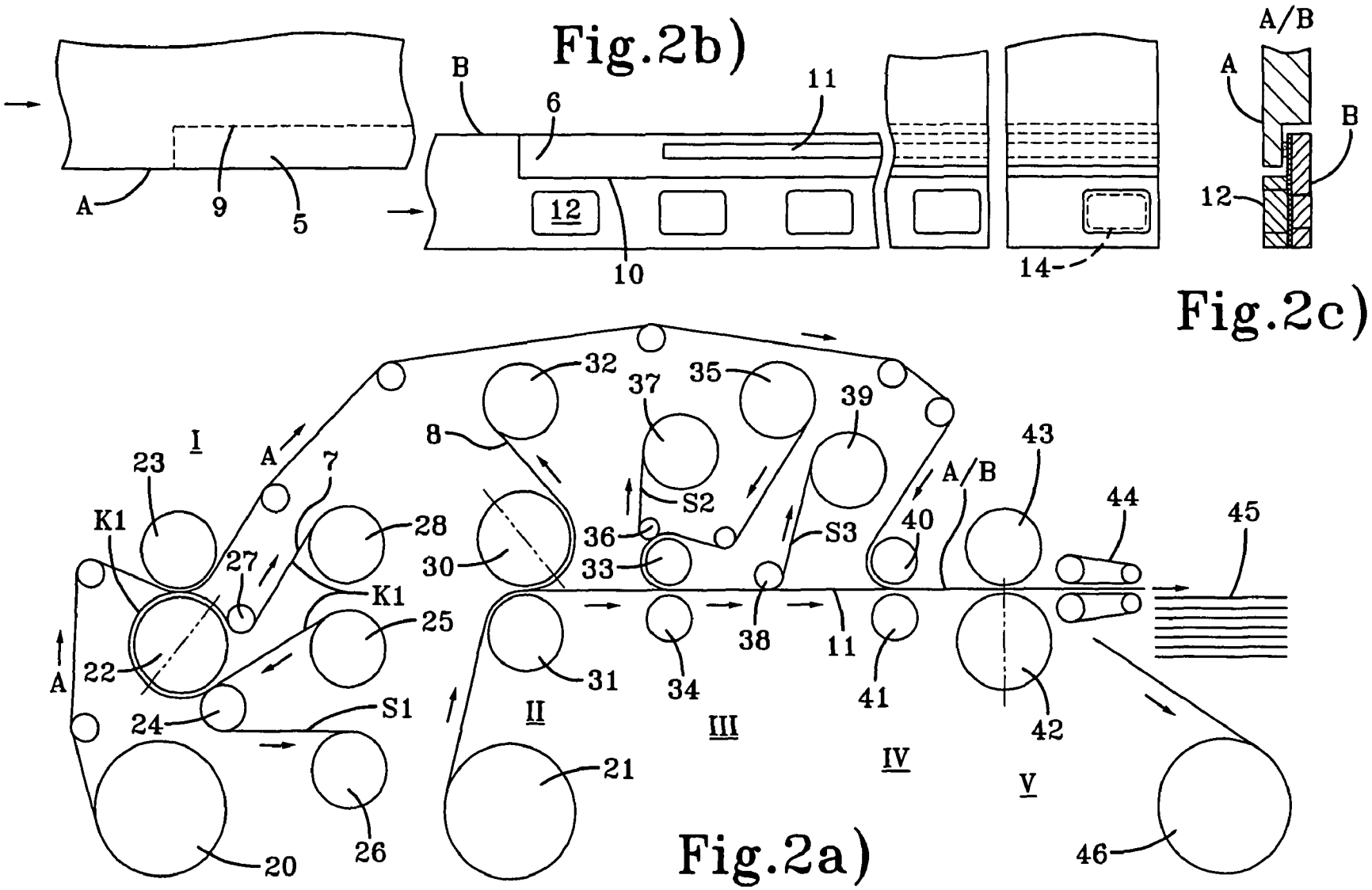
FIG. 2*a*) is a device for making the print carrier of FIG. 1 in a continuous process, in which two webs corresponding to the partial print carriers are processed and joined together coplanarly.
FIGS. 2*b*) and *b*') are plan views.
FIGS. 2*c*) and *c*') are cross-sections of these webs.

FIG. 2*a*) shows a device for making a print carrier A/B according to FIG. 1 in a continuous process using partial print carriers A and B, which are present as continuous webs and are unwound from feed rollers 20 and 21. FIG. 2*b*) shows plan views of the webs A and B running through the device of FIG. 2*a*). FIG. 2*c*) represents a section through the finished print carrier A/B.

From the feed roller 20, web A is taken to a first die-cut unit I with a die-cut cylinder 22 underneath and a opposing cylinder 23 on top, in which it runs onto the opposing cylinder 23 in the die-cut unit. The die-cut cylinder 22 is provided with at least one rotating cutting edge to produce the cut 9 of FIG. 1 as the web A runs through the gap between the two cylinders 22 and 23. Ahead of this gap in the direction of rotation, a roller 24 rests against the die-cut cylinder 22, whereby a first adhesive strip K1, with a supporting film layer and an adhesive layer, which is pulled off a roller 25, is transferred onto the die-cut cylinder 22 with the adhesive layer pointing outward. At the same time, a cover for the adhesive layer on the roller 24, such as one in the form of a silicone paper S1, is pulled off the adhesive strip K1 on the roller 24 and passes to a roller 26, onto which it is wound. The adhesive strip K1 comes in contact with the web A in the gap between the two cylinders 22 and 23, and there it is glued firmly to it under pressure. Subsequently, carrying along with it a partial layer of the paper layer of web A, as will be further explained below, it runs further around the die-cut cylinder 22 as far as a deflection roller 27, by which it is carried away from the die-cut cylinder and fed to a wind-up roller at 28.

The adhesive strip K1 is so proportioned in width and so oriented relative to the web A and the cutting edge 22.1 making the cut 9 in it (FIG. 3*a*)) that it comes to lie between one of the side edges of web A and the cut 9, and preferably the space between them is also essentially filled. In particular, it fits tightly against the cutting edge 22.1 on the die-cut cylinder 22.

While now, since the adhesion of the adhesive layer of the adhesive strip K1 to the paper material of web A is chosen to be greater than the internal strength of the paper material, it tears this up or frays it in the direction of travel on the aforesaid edge strips 5, so that a partial layer of the paper layer corresponding to the partial layer 7 of FIG. 1 remains stuck to the adhesive strip K1 on the die-cut cylinder 22, while web A besides runs further around the opposing cylinder 23. The partial layer 7 torn off by the adhesive strip K1 and stuck to it is wound up, together with the adhesive strip K1, onto the roller 28. The specific tearing conditions can be kept exactly constant in the procedure described, so that an approximately constant tear depth results, with a correspondingly constant attenuation of web A along its edge strip 5.

Therefore, three processes take place at nearly the same time in the gap between the two cylinders 22 and 23: the production of the cut 9 for a straight boundary at the edge strip 5 being attenuated, the application of the adhesive strip K1, and the tearing off of the partial layer 7 with the adhesive strip K1.

Web A with its attenuated edge strip 5 is then passed around various deflection rollers, including a second die-cut unit II, as is described below.

The second die-cut unit II contains a die-cut cylinder 30 on top and an opposing cylinder 31 underneath. This second die-cut unit II receives the web B fed from the feed roller 21 such that it runs onto the opposing cylinder 31. The die-cut cylinder 30, like the die-cut cylinder 22, is provided with at least one rotating cutting edge (30.1 in FIG. 3*b*)) to make the cut 10 of FIG. 1 as web B runs through the gap between the cylinders 30 and 31. Because of the cut 10, the strip-like layer 8 of FIG. 1*d*) is cut free and can then be pulled around the die-cut cylinder 30 besides from the rest of web B and can be wound up on a roller 32.

Web B with its thus attenuated edge strip 6 is then passed to a station III, at which an adhesive corresponding to the adhesive 11 of FIG. 1*e*) is applied in a strip to the attenuated edge strip 6. The adhesive 11 is applied dry by means of a pair of rollers 33, 34, using pressure, and is at the same time passed from a feed roller 35, on which it is arranged between two covering layers of silicone paper S2 and S3. One of these covering layers, S2, is, prior to applying the adhesive layer 11, pulled off it by a roller 36 running against the roller 33 and is wound onto a roller 37. The other covering layer, S3, is pulled off it by a roller 39 only after applying the adhesive 11 to web B and is wound onto a roller 38. The adhesive 11 then lies exposed on the top side of web B at its edge strips 6. In order for the adhesive 11 to be separated in the proper sequence from the covering layers S2, S3, its adhesion with respect to the covering layer S2 must be clearly less than with respect to the covering layer S3.

At another station IV with two press rollers 40 and 41, web A and web B are brought together and glued to each other with the adhesive 11, under pressure, overlapping their two attenuated edge strips 5 and 6, as is also evident from FIG. 2*c*). It is important that the pressure be exerted by the rollers 40, 41 in the overlap area, for which a so-called final adjustment is provided there. It can be seen from FIG. 2*a*) how web A passes around the press roller 40 and is joined to web B. In FIG. 2*b*), it can be seen that the two webs A and B have been moved laterally relative to one other by means of the device, so that both their attenuated edge strips arrive at station IV with the press rollers 40 and 41 with precisely the desired mutual overlap and are pressed together.

As a result, a print carrier A/B has already been finished according to the present invention, albeit in the form of a continuous web, which is wound onto a roller 46 and could be made available for further continuous processing, for example at a print shop. But in practice, there is an increasing need for single sheets that can be handled by sheet printers. For that reason, a third die-cut unit III is also provided in the device of FIG. 2*a*), with a die-cut cylinder 42 and an opposing cylinder 43, in which there is at least one cutting edge on the die-cut cylinder 42 that is oriented transverse to the direction of travel of the web A/B, for cutting single sheets to length from the web A/B. Reference 44 depicts a device for picking up and stacking the single sheets and 45 a stack of sheets. The sheets can have typical formats such as A4 or letter size.

Figure 3A:
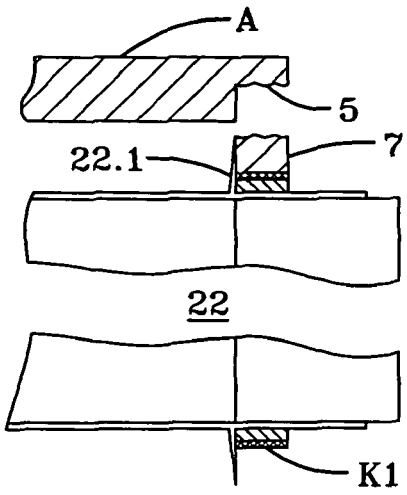
FIGS. 3*a*), *a*'), *b*), *b*)', and *c*) are cross-sections of the webs on different cylinders of the device in FIG. 2*a*)

FIGS. 3*a*), *b*) and *c*) clarify the situation at the three die-cut cylinders 22, 30 and 42 in the die-cut units I, II and III, in which the individual figures each show a longitudinal section through the die-cut cylinder and in which the sectional planes are each chosen as indicated by dashed lines, as in FIG. 2*a*).

FIG. 3*a*) shows the situation at die-cut cylinder 22 of the first die-cut unit I. The sectional plane is here chosen to be slightly slanted, so that it cuts the upper edge of the die-cut cylinder 22 shortly after the gap between it and the opposing cylinder 23, which is represented only in FIG. 2*a*). The cutting edge rotating at the die-cut cylinder 22 to produce the cut 9 in web A is indicated as 22.1 and is composed of a thin die-plate, which is held magnetically on the die-cut cylinder 22. The die-cut cylinder 22 is, moreover, like the other die-cut cylinders as well, incidentally constructed as a magnetic cylinder. The adhesive tape K1, as already described, passes to the die-cut cylinder 22 so that it fits tightly against the cutting edge 22.1. In the gap between the die-cut cylinder 22 and the opposing cylinder 23, the cutting edge 22.1 penetrates into web A. The adhesive strip K1 is also glued here under high pressure to web A. At almost the same time, the tearing and separation of the partial layer 7 from web A begins in the gap, while the adhesive strip K1 with the partial layer 7 adhering to it continues to run through some rotational angle on the die-cut cylinder 22, while web A rotates around the opposing cylinder 23 and, past the gap, is removed from the adhesive strip K1 and the partial layer 7, as can be seen in FIG. 3*a*).

Figure 3B:
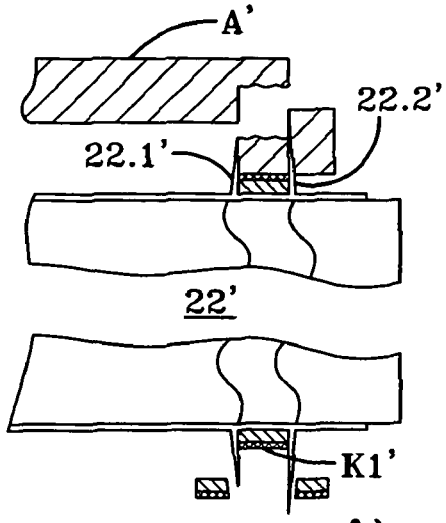
Figure 3B:
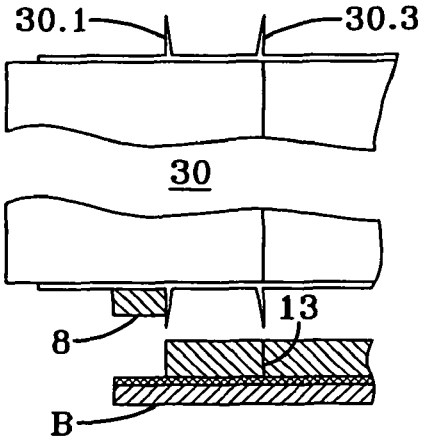

FIG. 3*b*) shows the situation at the die-cut cylinder 30 of the second die-cut unit II. Once again, the sectional plane is here chosen to be slightly slanted, so that the lower edge of the die-cut cylinder 30 is cut by it soon after the gap between it and the opposing cylinder 31, which is represented only on FIG. 2*a*). The cutting edge rotating at the die-cut cylinder 30 to make the cut 10 in web B is indicated as 30.1 and is again composed of a thin die-plate, held magnetically on the die-cut cylinder 30. The strip-like partial layer 8 of web B, cut free by means of the cut 10, is pulled off web B, while it runs further on the die-cut cylinder 30 through some angle of rotational, during which web B leaves the gap between the die-cut cylinder 30 and the opposing cylinder in a straight line.

In the embodiment examples described so far, the edge strips 5 and 6 of the two partial print carriers A and B are each oriented straight and parallel to one another, both as to their outer edges as well as the cuts 9 and 10. As a result, two hinge areas occur on the finished print carrier A/B, indicated as G1 and 62 in FIG. 1*g*), along which both partial print carriers A and B can be rolled against one another with little resistance. For many applications, this may be insignificant or even advantageous, but for others it may in comparison be undesirable. In the latter case, the hinge effect can be avoided to a large extent by means of a reciprocal gear-tooth construction of the two partial print carriers along their edge strips 5 and 6 and a bend-resistant connection produced. It is sufficient for this, for example, to construct the two edge strips 5 and 6 as reciprocally undulating in opposite directions, to be precise, in terms of their outer edges as well as the cuts 9 and 10, as is represented in FIG. 2*b*'), where the cuts are indicated as 9' and 10'. What is more, the cutting edges on the die-cut cylinders 22 and 30 must be constructed as correspondingly undulating, as FIGS. 3*a*') and 3*b*') show and where the corresponding cutting edges are indicated as 22.1', 22.2', 30.1', and 30.2'. The cutting edges 22.2' and 30.2' are required here, in addition, to cut the outer edges of webs A and B in an undulating pattern, whereby cutting waste results. The two cutting edges 22.1' and 22.2' on the die-cut cylinder 22 can at the same time be used to advantageous to cut out, for example, with straight edges, from the adhesive strip K1 fed from the roller 25, an adhesive strip K1' exactly matching in wavy contour; whereby again, cutting waste will naturally result here, but it can be removed along with the covering S1.

The thickness of the partial layer 7 torn away from the paper layer of the partial print carrier A to attenuate its edge, and as a result the measure of this attenuation, depend on the quality of the paper used as well as, in part, on the rate of tearing, but above all on the angle of tear, whereby the thickness decreases as the tear angle becomes larger. The depth of the cut 9 plays practically no role in this connection. A sharp-edged separation of the partial layer 7 will occur even if the depth of the cut 9 is somewhat less than the thickness of the partial layer 7. The adhesion of the adhesive strip K1 used in the device of FIG. 2*a*) to the paper surface plays no essential role in the thickness of the partial layer 7, as long as this adhesion is just large enough.

In the device of FIG. 2*a*), the tear angle is determined, on the one hand, by the diameter of the die-cut cylinder 22 and on the other hand by that of the opposing cylinder 23. These diameters typically amount to 110-150 mm for the die-cut cylinder 22 and 60-140 mm for the opposing cylinder 23 and thus are relatively large, which yields a relatively small tear angle and a large thickness of the partial layer 7 torn off, which is usually favorable in practice. If, however, one wishes to reduce this thickness, the modified die-cut unit I' can be used, for example, as represented in FIG. 2*d*). With this, the web A and the adhesive strip K1 with the attached partial layer 7 are separated from one another onto a pair of rollers 29 with distinctly smaller diameter, arranged behind the die-cut cylinder and opposing cylinder.

Due to the measures described above, the thickness of the partial layer 7 can be adjusted relatively precisely to the respective desired value, particularly in the 20-120 μm range where, for example, a thickness of 25 μm is suitable for paper with a density of 80 g/m$^2$ and a thickness of 50 μm is suitable for paper with a density of 120 g/m$^2$. For paper with density greater than 140 g/m$^2$ and over 185 μm thick, the thickness of the partial layer 7 can be as much as 100 μm.

The laminate used in FIGS. 1-3 for the partial print carrier B and the web B is specially suited to making integrated cards, in particular if the layer 2 is sufficiently thick, rigid, and thus self-supporting. The device of FIG. 2*a*) also allows, based on, the die-cut units which there anyway, just such integrated cards to be produced, at least in the laminate of web B in layer 2 in the same run as the bonding of the two webs A and B. What is more, it is sufficient in principle to provide the die-cut plate in the die-cut cylinder 30 with an additional rotating cutting edge, as represented in FIG. 3*b*) and FIG. 3*b*') and indicated as 30.3, and with this to cut into web B on the side of the layer 2 down to the depth of the peelable adhesive layer 3. The cards thus cut out along their perimeter from layer 2 are indicated by 12 in FIG. 2*b*) and FIG. 2*b*') and the corresponding cut in layer 2 by 13 in FIG. 3*b*) and FIG. 3*b*'). The integrated cards 12 are held on web B and in the finished print carrier A/B by the peelable adhesive layer 3 on layer 4, but they can also be detached from layer 4 by virtue of the separation properties of the peelable adhesive layer 3 and removed from the print carrier A/B.

Figure 3C:
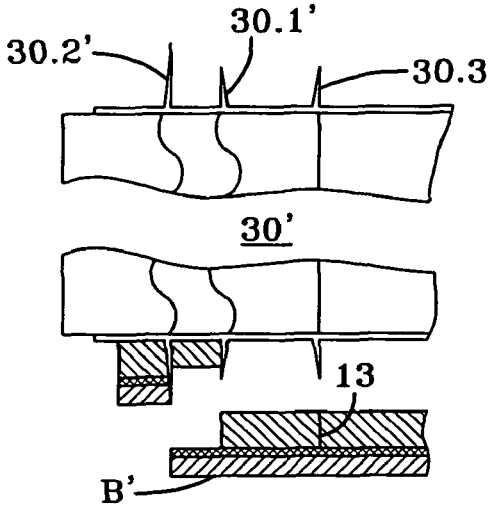
Figure 3C:
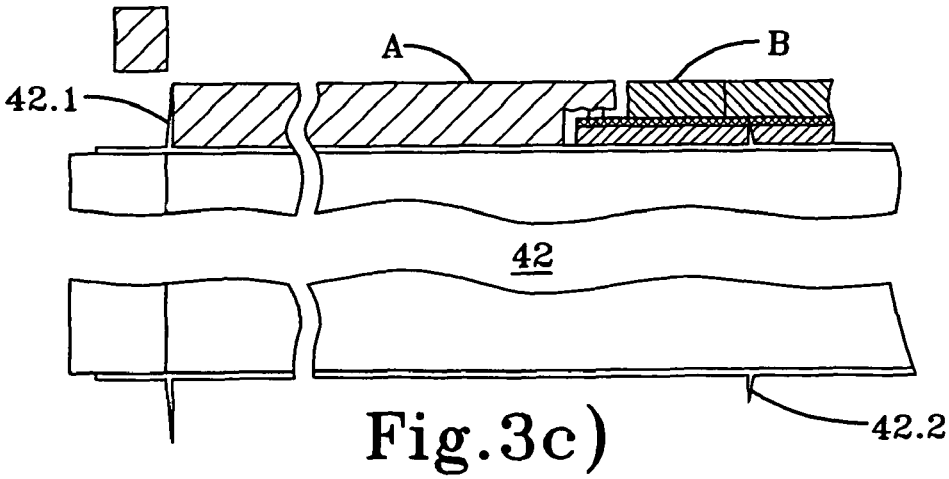

On the die-cut cylinder 42 of the third die-cut unit III of the device of FIG. 2*a*), a die-plate could be provided, as represented in FIG. 3*c*), for example, with a rotating cutting edge 42.1, whereby this cutting edge 42.1 could cut out individual print-carrier sheets from the web A/B, by producing a die-cut grid (rather than cutting the web to length and crosswise). Alternatively or also in addition, a rotating cutting edge 42.2 could be used to cut into layer 4 of web B. This would be of interest, for example, within the contours of integrated cards 12 produced in layer 2 of web B, as represented by a dashed line in FIG. 2*b*) or FIG. 2*b*') and indicated by 14, because a layer would thereby be produced that would accompany the integrated cards 12 at their removal from the print carrier, which could, for instance, be provided with a previously applied imprint.

Figure 4A:
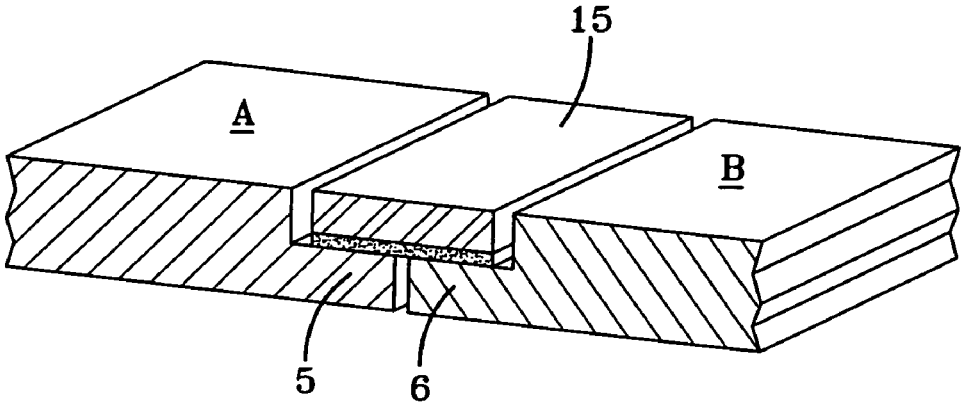
FIGS. 4*a*)-*c*) are alternative embodiments for the coplanar connection of two partial print carriers by means of strips.

In the embodiment examples described above, the partial print carriers A and B were joined together coplanarly with a mutual overlap of their two attenuated edge strips 5 and 6. FIG. 4*a*)-*c*) shows basically how this might be possible without any mutual overlap of these edge strips, in contiguity, by using one strip 15 or two strips 15 and 16, whereby the strip or strips each bridge the contiguous area. The total thickness, consisting of the residual thickness of the two edge strips and the thickness of the strip or strips, shall further correspond roughly to the thickness of the two partial print carriers A and B. In particular, the strips 15 and 16 can be adhesive strips.

Figure 4B:
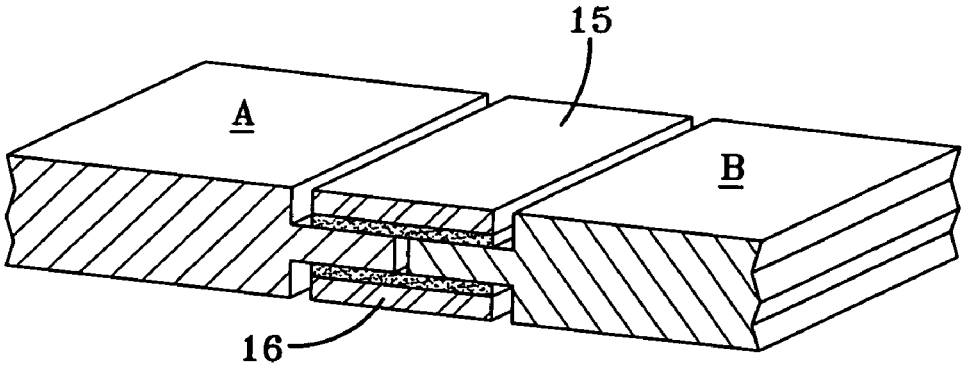
Figure 4C:
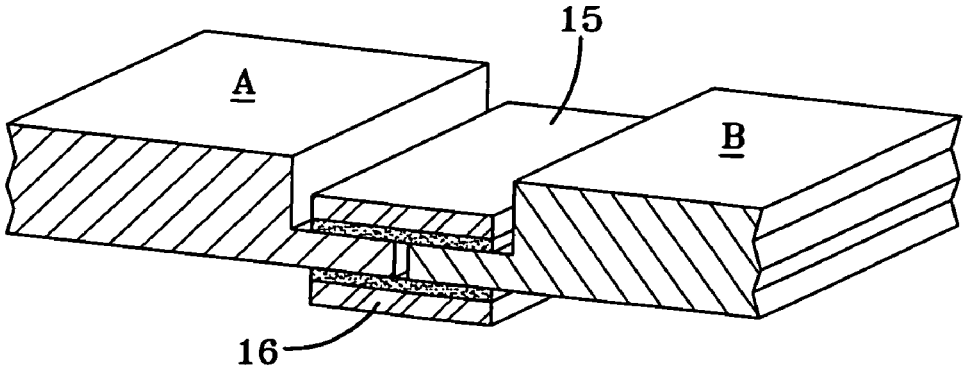

The partial print carriers A and B are not further specified as to their construction in FIG. 4. Actually, there could be a single paper layer in both of the partial print carriers. One or both partial print carriers could also be a multilayered laminate, such as, for example, that represented for partial print carrier B in FIG. 1 and used to make integrated cards in FIGS. 2 and 3.

A plastic film, in particular in layer 2, for example, made of polyester with a thickness in the range of 75-250 μm could be used in the multilayered laminate, as is represented for partial print carrier B in FIG. 1 and is used to make integrated cards in FIGS. 2 and 3. The peelable adhesive layer could exhibit a thickness in the range of 3-10 μm, and the layer 4 could be a carrier layer with a thickness of 23-36 μm. In this case, there would result a total thickness for the partial print carrier B, and thus, preferably, also for the paper material of the partial print carrier A, between 101-296 μm. The paper material preferred to be used would be one having a large volume and low weight, i.e., a low density.

The two edge strips 5, 6 could, in particular for a bond with mutual overlap, exhibit a width between 3-12 mm, but preferably between 4-8 mm.

Figure 7:
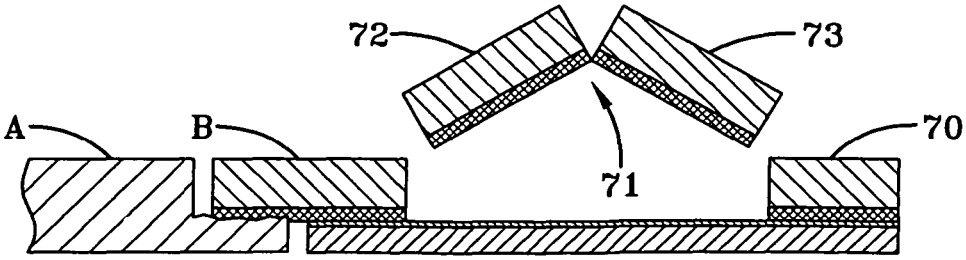
FIG. 7 is a representation according to FIG. 6*b*), a print carrier according to the invention, in cross-section, with a folding card removed.
Figure 8A:
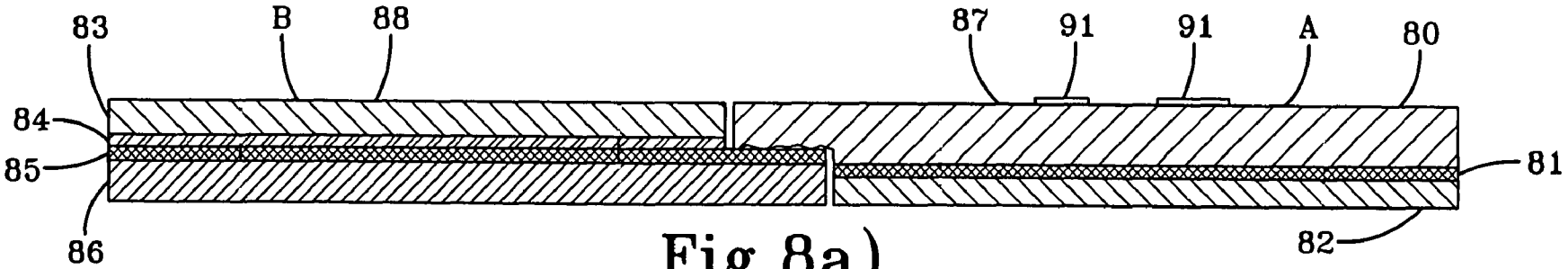
FIG. 8*a*) is another print carrier according to the invention, in cross-section, with an integrated flip card.
Figure 8B:
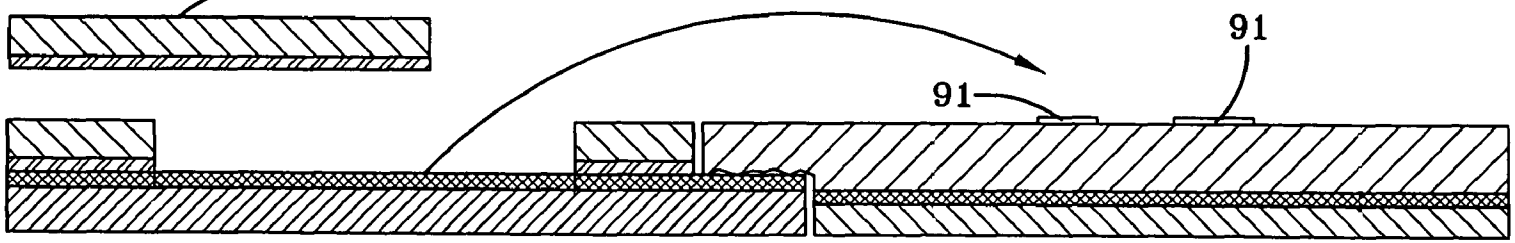
FIG. 8*b*) is steps for making the flip card.
Figure 8C:
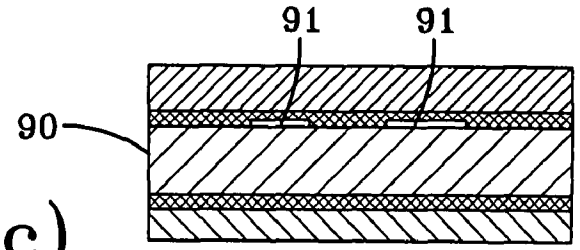
FIG. 8*c*) is the flip card released.

In FIGS. 5-8, further selected examples of the layer construction for the two partial print carriers A and B are clarified, on the one hand their bonding as facilitated according to the invention and on the other hand the manufacture of various integrated products, where the partial print carrier A in FIGS. 5-7 again consists respectively of only a single paper layer, while the partial print carrier B is respectively a multilayered laminate.

Figure 5A:
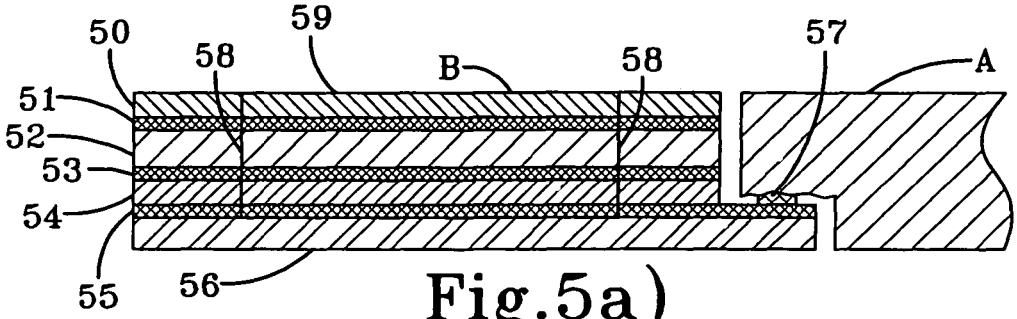
FIG. 5*a*) is a print carrier according to the invention, in cross-section, with an integrated card.
Figure 5B:
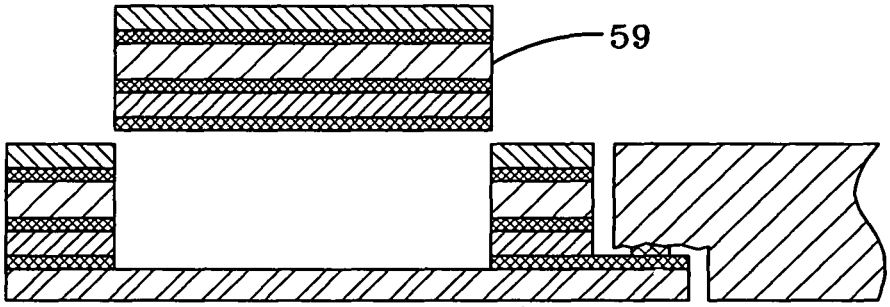
FIG. 5*b*) is the print carrier with the card removed.

In FIG. 5, partial print carrier B exhibits the following layered construction from top to bottom: a first film covering-layer 50, a first adhesive layer 51, a paper layer 52, a second adhesive layer 53, a second film covering layer 54, a peelable adhesive layer 55, and a carrier layer of paper or film 56. Along one edge strip, a strip with the layers 50-54 is removed from the peel adhesive layer 55 and is glued together there with an attenuated edge strip of the partial print carrier A by means of an adhesive 57, with overlap. Due to a rotating die-cut 58, extending from the first film covering-layer 50 down to the peelable adhesive layer 55, an integrated card 59 is cut free in the partial print carrier B, which, by virtue of the separation properties of the peelable adhesive layer 55, can be removed and is shown as removed in FIG. 5*b*). The card 59 exhibits, as is often the case with such cards today, a paper core 52 with plasticizing on both sides by means of the film covering-layers 50 and 54.

Figure 6A:
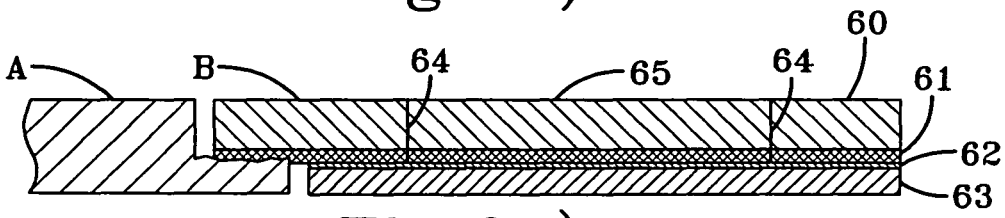
FIG. 6*a*) is a print carrier according to the invention, in cross-section, with an adhesive label, and FIG. 6*b*) is the print carrier with the adhesive label removed.
Figure 6B:
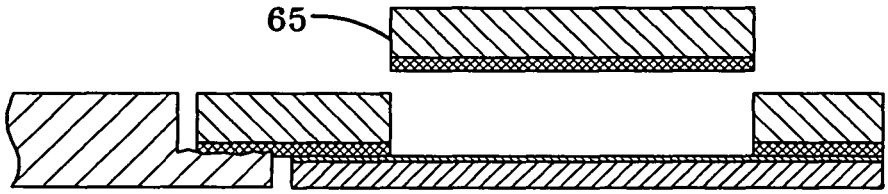

In FIG. 6, the partial print carrier B exhibits, from top to bottom, a layer 60 consisting of paper, for example, an adhesive layer 61, a silicone parting layer 62, and a carrier layer 63 of paper or film. Along one edge strip, a strip with the layers 62 and 63 is removed from the adhesive layer 61 and glued there with overlap an attenuated edge strip of the partial print carrier A, using the adhesive of the adhesive layer 61. Due to a rotating die-cut 64 in the layer 60, an integrated self-adhesive label 65 reaching down to the parting layer 62 is cut free in the partial print carrier B, which can be removed due to the separation properties of the parting layer 62, and is represented as removed in FIG. 6*b*).

FIG. 7 shows that a laminate with a wear layer 70, corresponding in construction to the laminate of the partial print carrier B of FIG. 6, could also be used to make, for instance, a folded card 71 which is not sticky on the outside, which after folding together and gluing its parts 72 and 73, exhibits more than twice the thickness of the layer 70. The layer 70 here could advantageously be a relatively thick film layer.

FIG. 8 shows an embodiment in which the partial print carrier A is also a multilayered laminate and has, besides an upper paper layer 80, an adhesive layer 81 and a carrier layer 82 of tear-resistant film. This construction has the special advantage that no extra adhesive strip is needed to tear off a partial layer of the paper layer 80 in order to attenuate it at the edge, because such is already there, due to the layers 81 and 82. It is sufficient to provide the partial print carrier A with a cut, after which the partial layer of the paper layer 80 can be torn off immediately with the integrated adhesive strip.

The partial print carrier B of FIG. 8 exhibits the reverse sequence of layers to that of FIG. 6 or 7 with the layers 83-86, where layer 86 is a transparent film layer. To attenuate the margin of the partial print carrier B, a strip with the layers 83 and 84 is removed, in which layer 84 is a parting layer that can be readily detached from the adhesive layer 85. The adhesive of this adhesive layer is immediately used to bond the two partial print carriers A and B, so that, again, no extra glue is needed.

From the construction described above, a flip card 90, for example, can be produced, in which an imprint 91 previously applied to the paper layer 80 of the partial print carrier A is arranged, protected under a transparent film layer. For this, a first partial card 87 is cut free in the partial print carrier A by a first die-cutting, in which, however, it is still held in the partial print carrier A by means of individual webs in the carrier layer 82. A second partial card 88 is cut free in the partial print carrier B by a second die-cutting, which is likewise still held in the partial print carrier B by means of individual webs in the layer 86. To make the flip card, in a first step, the part indicated as 89, containing the layers 83 and 84, is removed from the partial print carrier B, whereby the underlying are an of the adhesive layer 85 is uncovered. In a second step, the partial print carrier B is folded around the bonding area on the partial print carrier A like a hinge, whereby the exposed adhesive layer 85 comes in contact with the surface of the partial card 87 provided with the aforesaid imprint 91 and can be glued to it. In a third step, the finished flip card 90 can be removed from the print carrier A/B by breaking the aforesaid webs.

Figure 9A:
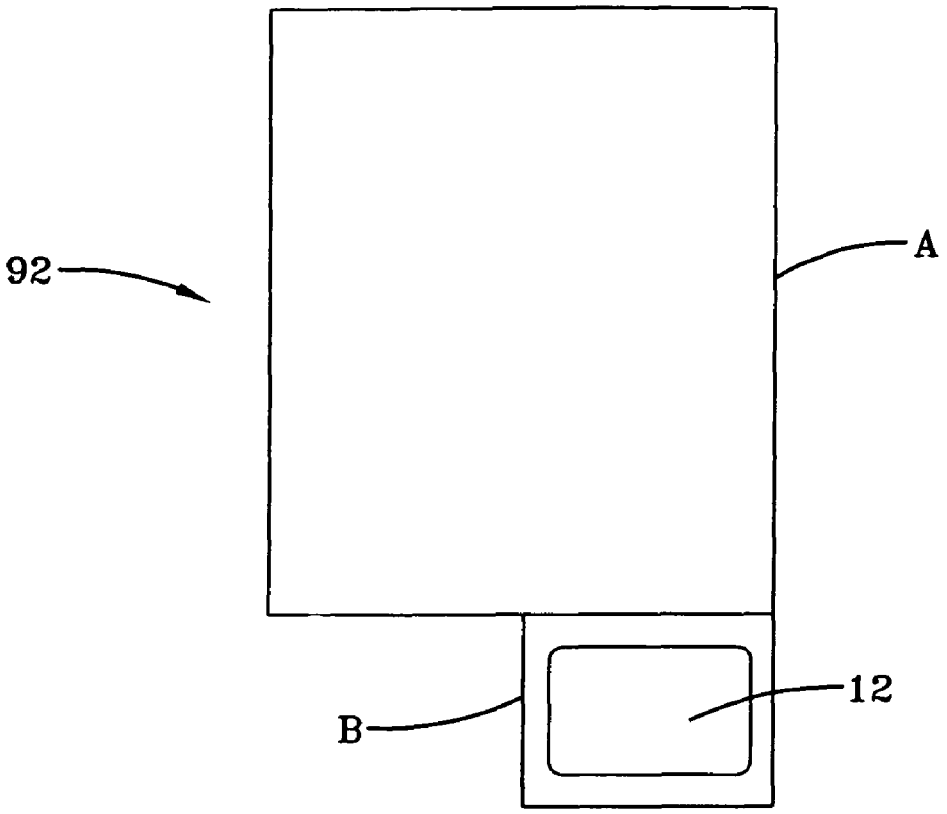
FIG. 9*a*) is a plan view of print carrier sheets with different widths of partial print carrier.
Figure 9B:
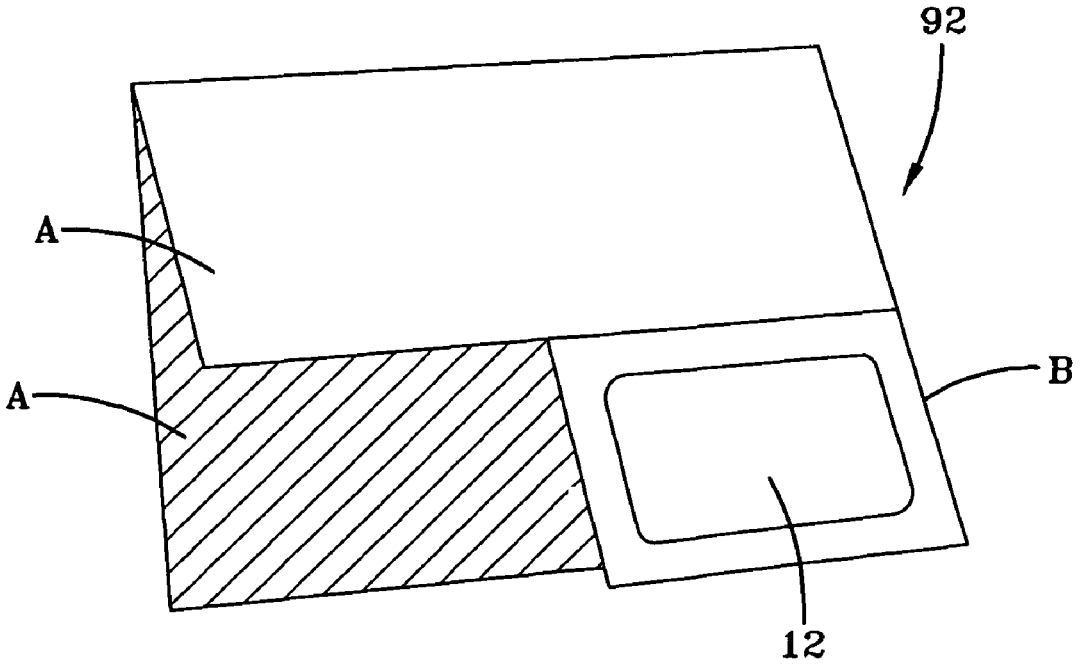
FIG. 9*b*) is the print carrier folded.

Print carriers A/B according to the invention are ultimately required, for their use according to the specification, in the form of individual sheets, in which the form as are most commonly A4 at 297×210 mm or letter size at 297×216 mm. Insofar as a simple integrated card or label is merely available here in the partial print carrier B in the usual check format of 85×54 mm, these are half as wide as the partial print carrier B, even if these are arranged at the short end of the A4 or letter format. More than half of the considerably more expensive materials for partial printing carried B are not taken advantage of in this case, compared with partial print carrier A. FIG. 2*b*) shows this case. In contrast, a construction, as shown in FIG. 9*a*) and in which partial print carrier B extends over only half the short end of the print-carrier sheets or partial print carrier A is fully taken advantage of in practice. FIG. 9*b*) shows the same print-carrier sheets simply folded together, whereby only the half-wide partial print carrier B is supported and protected by the full-width partial print-carrier A and in this case is without problems, for example, in being able to be inserted in an envelope.

Hereinafter a method is explained with which print-carrier sheets 92 of the type in FIG. 9*a*) can be efficiently and in a practically waste-free manner produced in a continuous process. In this method, three partial print-carrier webs A1, A2, and B1 operate at the same time, in which the partial print-carrier webs A1 and A2 are arranged on either side of the partial print-carrier web B1 and with it are each joined coplanarly in a manner described according to the invention as a three-part print carrier A1/B1/A2.

Figure 9D:
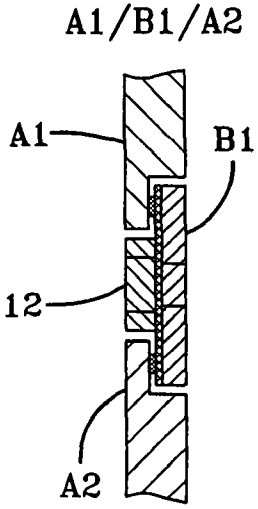
FIGS. 9*d*) and *e*), respectively, are a section through the two-part partial print carriers A1/B1/A2 occurring thereby.
Figure 9C:
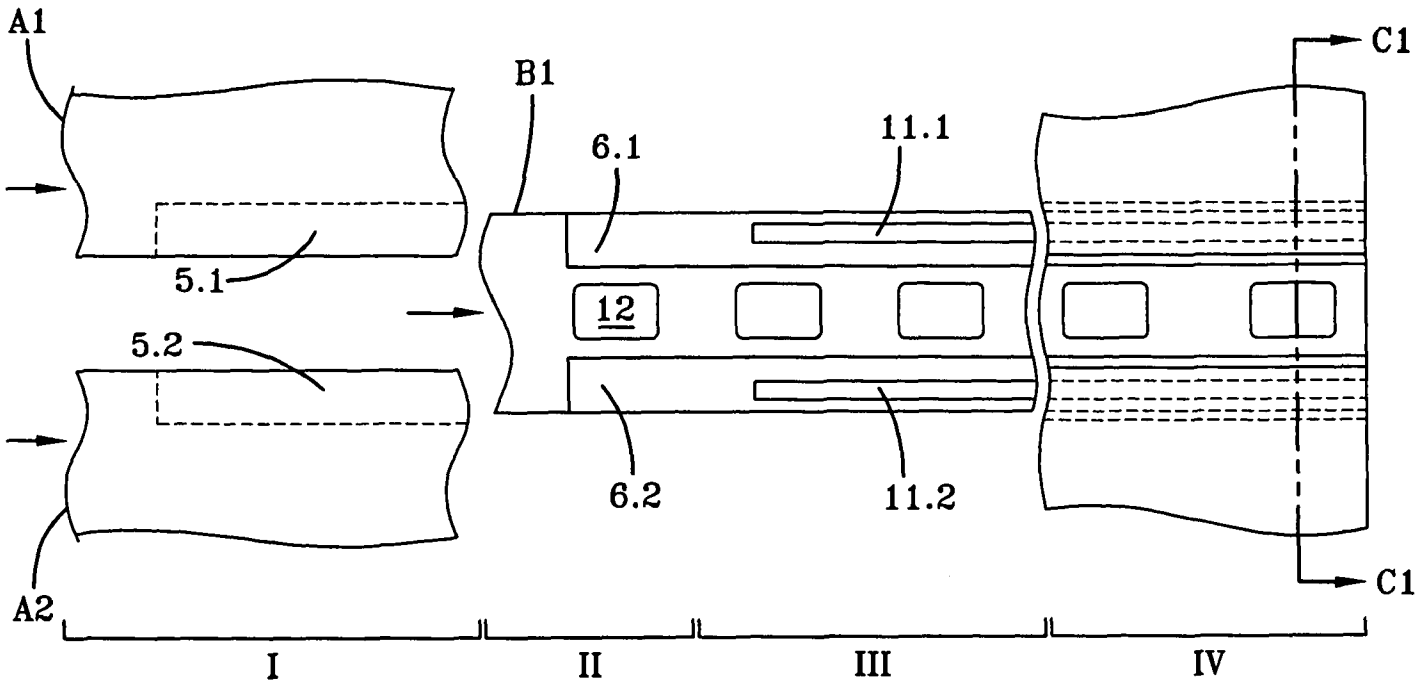
FIG. 9*c*) is plan views of webs A1, A2, and B1 in a run through units corresponding to the units I-IV of FIG. 2*a*)

The method can be executed with a device corresponding to FIG. 2*a*, with die-cut units I, II, and III, whereby additional units simply have to provided for supplying and connecting the third partial print-carrier web A2 to the partial print-carrier web B1. The unwinding of the partial print-carrier web A2 can occur on the same line as for the partial print carrier A1. The attenuation of the edge strips, the different die-cut units, and the adhesives must be doubled. FIG. 9*c*) shows plan views of the webs A1, A2, and B1 in a run through units I-IV of a correspondingly constructed device. The middle web B1 is, for example, a multi-layer laminate according to that of FIG. 5, which is especially suited to manufacture integrated cards 12. Both of the outer partial print carriers A1, A2 can be paper webs. FIGS. 9*d*) and *e*) show the resulting three-part print-carrier web A1/B1/A2 respectively in section C1-C1 of FIG. 9*c*) and C2-C2 of FIG. 9*f*).

Print-carrier sheets 92 corresponding to FIG. 9*a*) lie in pairs in the three-part print-carrier web A1/B1/A2 oriented oppositely. The parting line 93 between the facing print carrier 92 runs alternately along the outer edges of the middle partial print carrier B1, as is indicated in FIG. 9*e*) and in between crosswise through the middle partial print carrier B1. By means of appropriate trimmings and die-cuts of the print-carrier web A1/B1/A2, the print-carrier sheets 92 are obtained from the print-carrier web A1/B1/A2 corresponding to FIG. 9*a*).

Figure 9F:
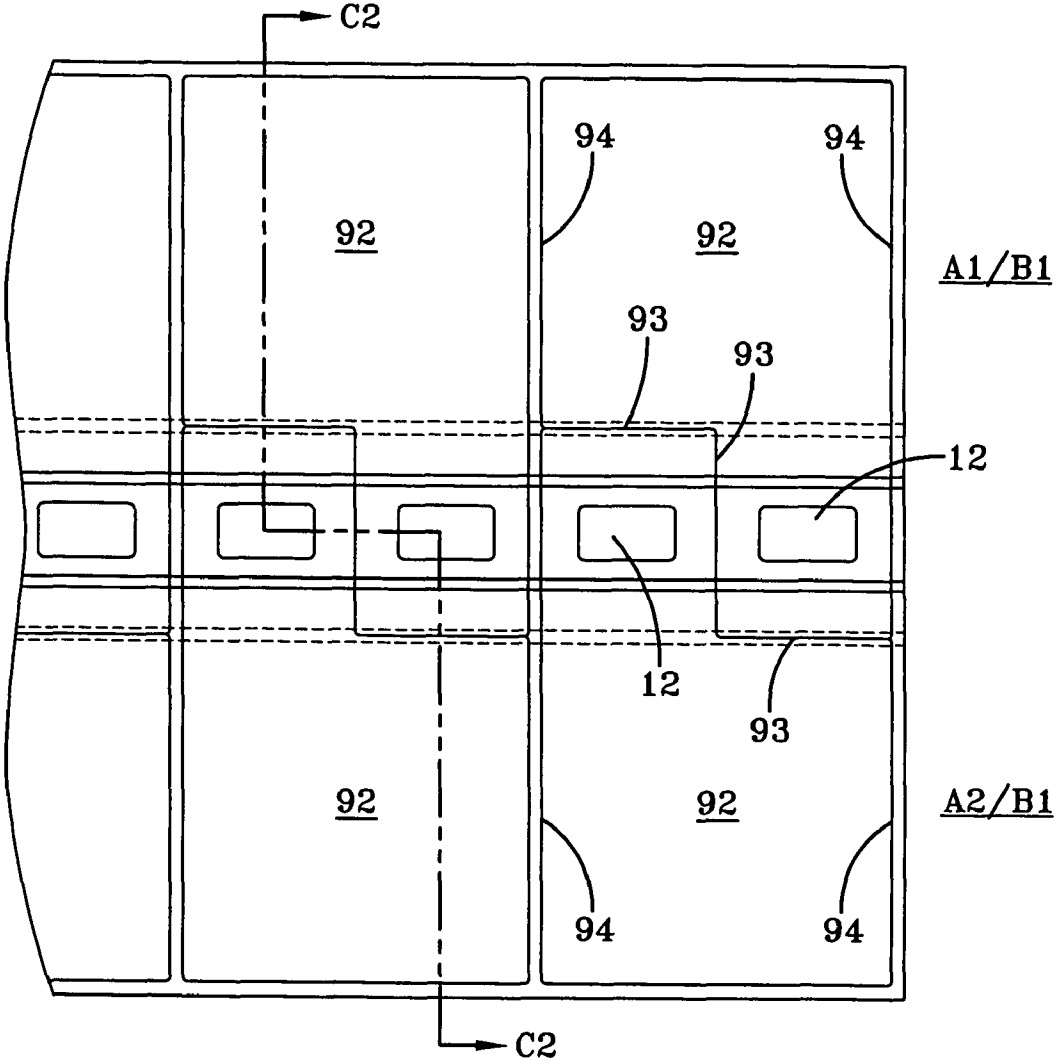
FIG. 9*f*) is a plan view of these print carriers in a run through a die-cut unit corresponding to the die-cut unit V of FIG. 2*a*)
Figure 9E:
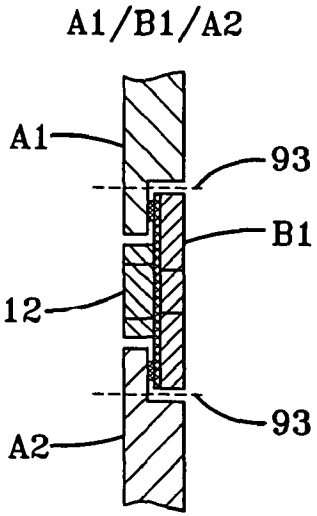

FIG. 9*f*) shows a plan view of the print-carrier web A1/B1/A2 in a run through a die-cut unit V of the same device. In this die-cut unit V, for example, by means of one of the die-plates arranged on a magnetic cylinder, individual print-carrier sheets 92 corresponding to FIG. 9*a*) are cut out in pairs from the running web A1/B1/A2, in which the parting line 93 between the facing print carriers exhibits the shape of a right-angled curve, as has already been mentioned, running alternately along the outer edges of the middle partial print carrier B1. These are represented in FIG. 9*f*) as dashed hidden lines. At the same time, the print-carrier sheets 92 in the die-cut unit III are also cut in the desired format (die-cut lines 94), in which a die-cut grid arises. By turning each print-carrier sheet 92 in each pair of sheets contained, all the print-carrier sheets 92 can be brought to cover one another and be stacked respectively with the partial print carrier B1, for example, at the lower right.

It would also be possible to simply undo the three-part print-carrier web A1/B1/A2 in the die-cut unit III along the parting line 90 into two opposing webs A1/B1 and B1/A2 a and to wind these up, for example, for further continuous processing later. Likewise it would be possible to lengthen the print-carrier sheets without outside cuts by simple cross-cutting of the web in pairs.

The method described above, besides the fact that it allows for practically waste-free manufacture of print-carrier sheets according to FIG. 9*a*), is also for that reason highly efficient, because the print-carrier sheets according to FIG. 9*a*) always occur in pairs. A pair-wise production of "normal" print-carrier sheets, for example according to FIG. 2*b*) is, in contrast, not so readily possible, because the printing or web-finishing machines, as are usually used in the manufacture and processing of print carriers according to the invention, exhibit a standardized width of only 520 mm. This is not sufficient to allow for running two webs with a width corresponding to the height of an A4 format next to each other. In the method described for manufacture of a three-part print-carrier web A1/B1/A2 of a print carrier according to FIG. 9*a*), however, parts of the middle web B1 are attached at the parting along the parting line 90 alternating the two outer webs A1, A2. The finished two-part print carrier A1/B1, A2/B1 can consequently exhibit a total height corresponding to the height of the A4 format, although the three-part print carrier A1/B1/A2 exhibits a clearly smaller width, in particular a width of less than 520 mm.

Figure 10A:
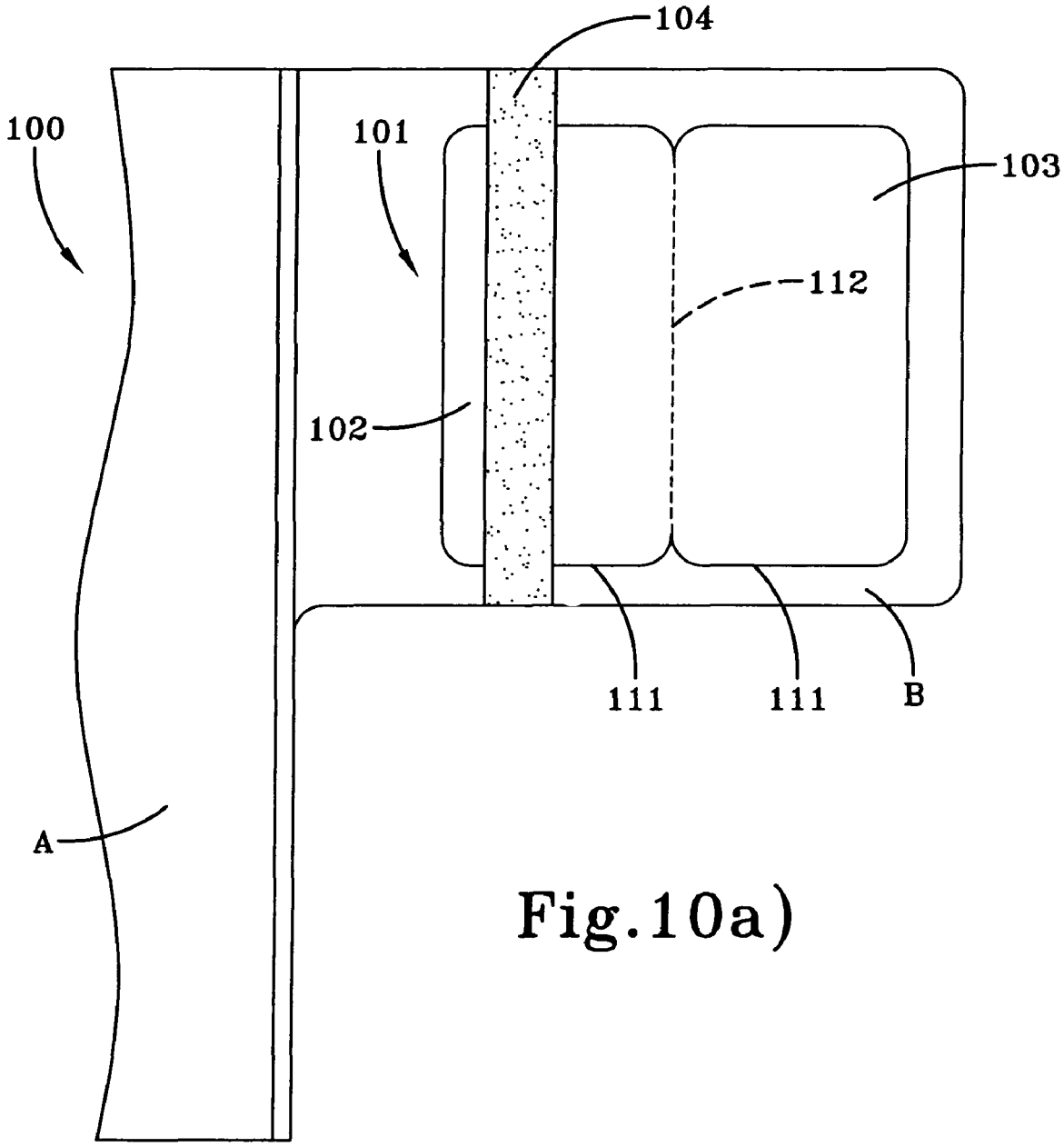
FIG. 10*a*) is a plan view of further print carrier sheets with different widths of print carriers and an integrated folding card in the print carrier B as well as, respectively in section.

FIG. 10*a*) shows a further print-carrier sheet 100 in plan view according to the invention, in which the partial print-carrier B extends only over half of the short end of the print-carrier sheet or the partial print carrier A. A folding card B is integrated here into the partial print carrier B, parts of which are indicated as 102 and 103. Above part 102 of the folding card 101 there runs, parallel to the overlapping edge strips of parts A and B, moreover, as an optional addition, a magnetic tape for information storage. Also, these print-carrier sheets can be manufactured with the method described above out of a three-part print-carrier web, in which even reading and writing on the magnetic tape 104 could already occur on the running print-carrier web.

Figure 10B:
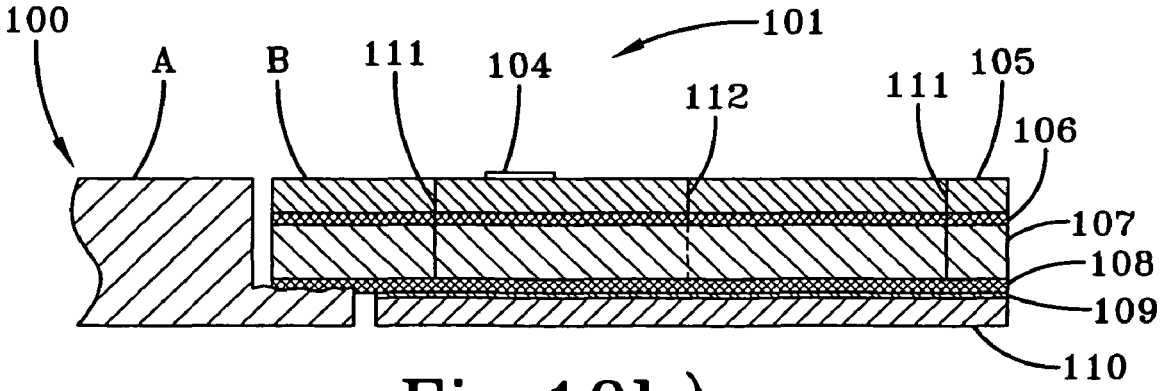
FIG. 10*b*) is the print-carrier sheets.
Figure 10C:
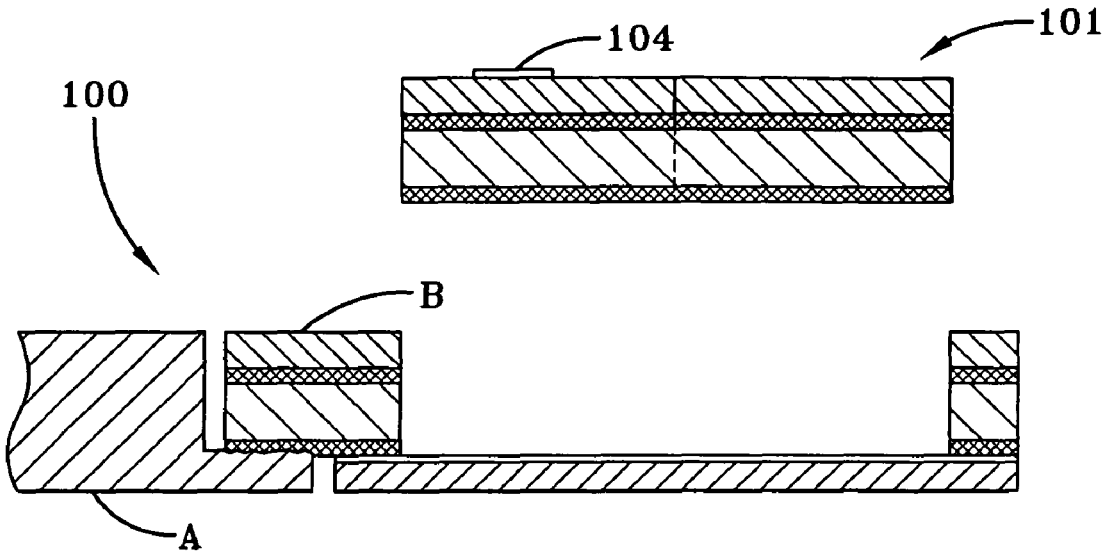
FIG. 10*c*) is the print-carrier sheets with the folding card.

The layered construction of the print carrier 100 is apparent from FIG. 10*b*). With the partial print carrier A, a simple, edge-attenuated paper layer can be handled, as is further represented. The partial print carrier B is a multilayer laminate and exhibits, from top to bottom, a layer 105, made of a synthetic film, for example, an adhesive layer 106, a layer 107 made of paper, for example, a further adhesive layer 108, a silicone parting layer 109, and a carrier layer 110 made of paper or film, for example. Along an edge strip of the partial print carrier B is a strip with layers 109 and 110 of the adhesive layer 108 removed and the partial print carrier B is glued overlapping there with an attenuated edge strip of the partial print carrier A by using the adhesive of the adhesive layer 108. By means of a web-less rotating die-cut 111 in the layers 105, 106, and 107, extending downward maximally to a carrier layer 110, the folding card 101 is cut free relative to the outside perimeter of their two parts 102 and 103 and can be removed from the partial print carrier B due to the separation properties of the parting layer 109, as FIG. 10*c*) shows.

Figure 10D:
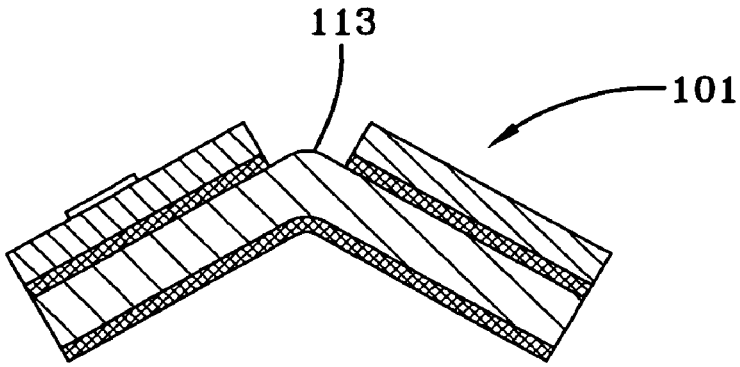
FIG. 10*d*) is the folding card bent overt.
Figure 10E:
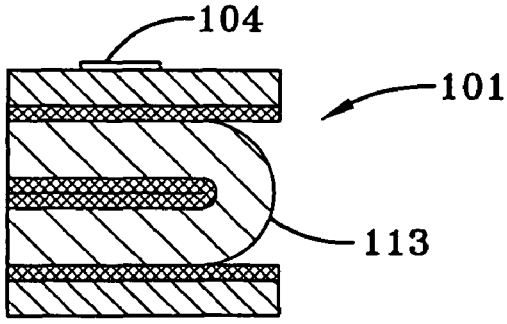
FIG. 10*e*) is the finished folding card.

Along the bonding line between the two parts 102 and 103 of the folding card 101 a further die-cut line 112 is available as a folding aid, which is executed in the layer 105 as a fully penetrating cut, in the layer 107 in contrast as a perforation with webs, and/or in this layer as an end not fully severed. Both parts 102 and 10 thus simply hang together above the layer 107 and in this also above only individual webs and/or above a certain residual thickness. This is recognizable in FIG. 10*d*), where the cut line of the picture is selected in the area of a die-cut web 113 between the two parts 102 and 103.

FIG. 10 shows the finished folding card 101, folded together and glued, relative to its parts 102 and 103. Here the layers forming, which originate from the layer 105, external and therefore the covering layers of the folding card 101, have no bonding to one another. Their encircling smooth and web-less cut edge in essence defines the outer contour of the folding card 101. The inner webs 113 between the layers serving as the core layers of the folding card, which originate from the layer 107, are in contrast barely recognizable and are practically unnoticeable by touch. The folding card 101 thus gives as a whole, in spite of the webs 113 present, the impression of a generally web-free card. This is particularly pronounced if the covering layers are of a relatively thick and rigid film and the core layers are of a thinner paper layer in comparison. For machine reading and writing of the magnetic tape 104, a certain rigidity should be available anyway in the finished folding card 101.

The examples explained above are in no way to be understood as conclusive. Rather, they merely clarify that the present invention can be applied with a plurality of differently constructed partial print carriers and that within the framework of the present invention, even the most diverse integrated products can be made as a result.

In order to avoid skewing in the stack, the two partial print carriers joined together should have the same thickness whenever possible. However, certain thickness differences can be tolerated. The resultant planar position for a thickness difference of up to at least +/−5% will be sufficient for most applications.

Integrated cards, folding cards, or labels typically exhibit dimensions of 55 to 85 mm, so that the partial print carrier B preferably used for their manufacture can exhibit a width of 80 mm. If the partial print carrier B in a print carrier A/B according to the invention, for example, is arranged in the format of an A4 sheet along one of its short sides, the partial print carrier A will definitely have a height of more than 200 mm, so that the partial print carrier A, which can be made of an economical paper material, will constitute the largest part of the surface of the print carrier A/B.

In all the embodiment examples described above, the differentiation along the edge strip of the partial print carrier B, if this is a multilayered laminate, could also be achieved by measures other than attenuation by removing individual layers, in particular, when making the laminate itself.

In the method explained with the aid of FIG. 2, print carriers A/B with integrated card according to the invention could be made in a single run, whereby the method and the device used for it have to be modified somewhat according to the layered construction of the partial print carrier used. So, for example, to make the print carrier of FIG. 8, no extra adhesive strip K1 or any adhesive 11 is needed. Also, an adhesive could already be present in web A, and after exposing this adhesive, only a small uncoated strip would have to be applied. If need be, tearing off the partial layer of the paper layer can also be done entirely without the aid of an adhesive strip. It would also be possible to use the first die-cut unit of FIG. 2 exclusively with its additional units and to simply create a paper web attenuated at its edge in a single run, which could even be delivered to another manufacturer as starting material for further processing later. This attenuated paper web could also be already provided along its attenuated edge strip with an adhesive layer covered by a detachable covering layer.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

The invention claimed is:

1. A print carrier comprising two laminar partial print carriers, wherein one of the partial print carriers contains a single layer of paper, the paper layer is attenuated in thickness along an edge strip by a removal of a partial layer of the paper layer, and the other partial print carrier has a lesser thickness along an edge strip than elsewhere on said other partial print carrier, and wherein both partial print carriers are coplanarly joined together along their respective edge strips.

2. The print carrier according to claim 1, wherein the removal of the partial layer has been done by tearing off the partial layer.

3. The print carrier according to claim 1, wherein the removal of the partial layer of the paper layer has been done by abrasion of the partial layer.

4. The print carrier according to claim 3, wherein the removal of the partial layer has been done by at least one process selected from the group consisting of grinding and milling.

5. The print carrier according to claim 1, wherein the two partial print carriers are bonded to each other along their respective edge strips with the respective edge strips overlapping one another.

6. The print carrier according to claim 5, wherein the thickness of the print carrier in the area where the two partial print carriers are bonded together along their respective edge strips is no greater than the thickness elsewhere on the thicker of the two partial print carriers.

7. The print carrier according to claim 1, wherein the two partial print carriers are bonded to each other along their respective edge strips with at least one additional strip in contiguity.

8. The print carrier according to claim 1, wherein the two partial print carriers have about the same thickness outside their respective edge strips.

9. The print carrier according to claim 1, further comprising a cut in the paper layer for delimiting the edge strip of said one of said partial print carriers from the rest of the paper layer.

10. The print carrier according to claim 1, wherein the other partial print carrier of said at least two laminar partial print carriers is a laminate comprising at least two layers separable from one another, at least one of said two separable layers being removable along an edge strip.

11. The print carrier according to claim 10, further comprising a cut in the laminate for delimiting the edge strip of the laminate from the rest of the laminate.

12. The print carrier according to claim 1, wherein at least one of the edge strips comprises a width between 3-12 mm.

13. The print carrier according to claim 12, wherein at least one of the edge strips comprises a width between 4-8 mm.

14. The print carrier according to claim 1, wherein the edge of at least one of said edge strips is straight or undulating.

15. The print carrier according to claim 1, wherein the other partial print carrier is shorter in the direction of its edge strip relative to the partial print carrier containing the paper layer.

16. The print carrier according to claim 15, wherein the other partial print carrier is only half as long as the partial print carrier containing the paper layer.

17. A partial print carrier for use in a print carrier, wherein said partial print carrier contains a single layer of paper, said paper layer being attenuated in thickness along an edge strip of said partial print carrier by a removal of a partial layer of the paper layer.

18. The partial print carrier according to claim 17, wherein the removal of the partial layer of the paper layer is a tearing off of the partial layer.

19. The partial print carrier according to claim 17, wherein the removal of the partial layer of the paper layer is an abrasion of the partial layer.

20. The partial print carrier according to claim 19, wherein the removal of the partial layer has been done by at least one process selected from the group consisting of grinding and milling.

21. The partial print carrier according to claim 17, further comprising a cut in the paper layer for delimiting said edge strip from the rest of the paper layer.

22. The partial print carrier according to claim 17, further comprising an adhesive layer covered by a detachable covering layer on said edge strip.

23. A method for making a print carrier comprising at least two coplanarly joined laminar partial print carriers or for making a partial print carrier for use in a print carrier, wherein one of said at least two coplanarly joined laminar partial print carriers or said partial print carrier comprises a single layer of paper, comprising the step of attenuating the paper layer in thickness along an edge strip of said partial carrier by removing a partial layer of the paper layer through tearing off the partial layer.

24. The method according to claim 23, wherein the step of tearing off the partial layer of the paper layer comprises the step of tearing off the partial layer with an adhesive strip.

25. The method according to claim 24, further comprising the step of pulling off the adhesive strip by a roller.

26. The method according to claim 23, wherein said method is executed as a continuous process on running webs.

27. A method for making a print carrier comprising at least two coplanarly joined laminar partial print carriers or for making a partial print carrier, wherein one of said at least two coplanarly joined laminar partial print carriers or said partial print carrier comprises a single layer of paper, comprising the step of attenuating the paper layer in thickness along an edge strip of said partial print carrier by removing a partial layer through abrasion of the partial layer.

28. The method according to claim 27, wherein said edge strip is delimited from the rest of the paper layer by a cut in the paper layer.

29. The method according to claim 27, wherein the step of removing the partial layer by abrasion is at least one process selected from the group consisting of grinding and milling.

30. The method according to claim 27, wherein the edge strip of the paper layer is delimited from the rest of the paper layer by a cut in the paper layer.

31. The method according to claim 27, wherein said method is executed as a continuous process on running webs.

32. A method for making a print carrier comprising at least two laminar partial print carriers, wherein one of the partial print carriers contains a single layer of paper, the paper layer is attenuated in thickness along an edge strip of the one partial print carrier by a removal of a partial layer of the print carrier, the other partial print carrier has a lesser thickness along an edge strip thereof than elsewhere on the other partial print carrier, and both partial print carriers are coplanarly joined together along their respective edge strips, wherein a laminate with at least two adhesively joined layers separable from one another is used for the other partial print carrier, said method comprising the steps of:

delimiting the edge strip from the rest of the laminate by a cut in the laminate; and detaching at least one of the adhesively joined layers for reducing the thickness of said laminate along the edge strip.

33. The method according to claim 32, wherein said method is executed as a continuous process on running webs.

34. A method for making a print carrier comprising at least two laminar partial print carriers, wherein one of the partial print carriers contains a single layer of paper, and wherein a laminate with at least two adhesively joined layers separable from one another is used for the other partial print carrier, said method comprising the steps of:

attenuating the paper layer in thickness along an edge strip of the one partial print carrier by removing a partial layer of the paper layer, delimiting an edge strip from the rest of the laminate of the other partial print carrier by a cut in the laminate, reducing the thickness of said laminate along the edge strip thereof by detaching at least one of the adhesively joined layers, and coplanarly joining together both partial print carriers along their respective edge strips.

35. The method according to claim 34, wherein the step of attenuating the paper layer in thickness along an edge strip of the one partial print carrier by removing a partial layer of the paper layer includes tearing off of the partial layer.

36. The method according to claim 35, wherein said method is executed as a continuous process on running webs.

37. A method for making a print carrier comprising at least two laminar partial print carriers, wherein one of the partial print carriers contains a single layer of paper, the paper layer is attenuated in thickness along an edge strip of the one partial print carrier by a removal of a partial layer of the paper layer, the other partial print carrier has a lesser thickness along an edge strip thereof than elsewhere on the other partial print carrier, and both partial print carriers are coplanarly joined together along their respective edge strips, said method comprising the step of:

transferring an adhesive layer from a carrier to one of the two edge strips to bind the two partial print carriers along their respective edge strips, with the two edge strips overlapping one another.

38. A method for manufacturing print carriers comprising two outer partial print carriers and one middle partial print carrier wherein both outer partial print carriers each contain a paper layer, each paper layer being attenuated in thickness along an edge strip by a removal of a partial layer of the paper layer, respectively, and wherein the middle partial print carrier comprises, along two outer edge strips, a smaller thickness than elsewhere on the middle partial print carrier, said method comprising the steps of:

forming a print carrier by bonding the outer partial print carriers with their respective edge strips to the outer edge strips of the middle partial print carrier, and cutting the so-formed print carrier into at least two print carriers;

wherein the cutting line alternatively passes along said edge strips and crosses the middle partial print carrier in between.

* * * * *